United States Patent [19]

Wilson, Jr. et al.

[11] 4,282,517

[45] Aug. 4, 1981

[54] AUTOMATIC RINGBACK FOR DIRECT CURRENT MONITORING SYSTEM

[75] Inventors: Stanley Wilson, Jr., St. Charles; Robert M. Borger, Overland, both of Mo.

[73] Assignee: Potter Electric Signal Company, St. Louis, Mo.

[21] Appl. No.: 6,357

[22] Filed: Jan. 25, 1979

Related U.S. Application Data

[63] Continuation-in-part of Ser. No. 859,019, Dec. 9, 1977, abandoned.

[51] Int. Cl.[3] ..... G08B 23/00

[52] U.S. Cl. ..... 340/503; 340/504; 340/506; 340/511; 340/661

[58] Field of Search ..... 340/503, 502, 504, 500, 340/506, 511, 537, 313, 661, 657, 662, 663, 664, 517, 509, 521, 531; 179/5 R, 5 P; 11/11

[56] References Cited

U.S. PATENT DOCUMENTS

| | | | |
|---|---|---|---|
| 3,124,793 | 3/1964 | Foster | 340/503 |
| 3,233,232 | 2/1966 | Brennon | 340/504 |
| 3,341,816 | 9/1967 | Davis et al. | 340/663 |
| 3,562,730 | 2/1971 | Hill et al. | 340/511 |
| 3,702,468 | 11/1972 | Sasaki | 340/511 |
| 3,786,501 | 1/1974 | Marnerakis | 340/511 |
| 3,797,008 | 3/1974 | Yuasa | 340/511 |
| 3,823,391 | 7/1974 | Worsley et al. | 340/502 |
| 3,854,127 | 12/1974 | Damon | 340/504 |
| 3,886,932 | 6/1975 | Suessmilch | 317/22 |

*Primary Examiner*—Donald J. Yusko
*Assistant Examiner*—Donnie L. Crosland
*Attorney, Agent, or Firm*—Jerome A. Gross

[57] ABSTRACT

A ringback circuit in a security protection system, of the type which monitors a dc current, automatically reports to remote premises that the central station has, at an appropriate time, received an indication that the dc current has been changed to the normal current level for night operation. At the central station, a change in the current level from normal daytime to normal night-time current is sensed, activating an oscillator. An electronic current limiter in the communications line responds to the oscillator through an isolation circuit, oscillating the current in the communications line, which activates a buzzer at the remote premises.

9 Claims, 2 Drawing Figures

AUTOMATIC RINGBACK FOR DIRECT CURRENT MONITORING SYSTEM

CROSS-REFERENCE TO RELATED APPLICATIONS

This application is a continuation-in-part of our prior co-pending application Ser. No. 859,019, now abandoned, filed Dec. 9, 1977.

BACKGROUND OF THE INVENTION

The present invention generally relates to direct wire monitoring systems of the type which monitor a direct current supplied from a central station to remote premises via a communications line. More specifically, it relates to circuitry for automatically indicating at the remote premises that the central station is acknowledging reception of a change in the current level from a first normal level to a second normal level.

A typical direct wire monitoring system utilizes a lower value nighttime current than the daytime current. The change in current is produced by manual switching of resistances at the remote premises, which is generally performed by the last person to leave the protected premises in the evening. After switching the resistances and before leaving the premises, he waits for a ringback signal from the central station via the communications line acknowledging reception of the normal nighttime current.

In the prior art, an operator at the central station, when made aware of the change to normal nighttime current, manually switched an alternating current source onto the communications line, ringing a buzzer at the remote premises to ackowledge the change. Since the central station operator monitored hundreds of such systems, and a large number of subscribers tended to switch to nighttime current in a short time interval in late afternoon, there might be a long delay before the central station operator could ring back.

A U.S. patent to Damon, No. 3,854,127, discloses an alarm system which automatically sounds a ringback buzzer at remote premises after a change from normal daytime to normal nighttime current is detected at the central station. As disclosed, two power sources are required: a dc source for supplying monitoring current and a 20 Hz ac source to activate the buzzer. The ac source is switched onto the communications line when it is desired to ring the buzzer.

SUMMARY OF THE INVENTION

The primary object of the present invention is to provide an automatic ringback for a direct wire monitoring system, and particularly one which eliminates the necessity for two power sources, a first to supply monitoring current and a second to supply the buzzer, as was required by prior ringback apparatus. Another object is to verify the condition under which ringback is made before signalling the ringback; for example, the condition that the change from normal daytime to nighttime current shall occur within a prescribed time interval. A further object is to provide an automatic ringback which requires no modifications to other standard alarm system components.

Briefly described, the present invention has an input circuit which senses changes in the value of the dc current in the communications line. Comparator circuitry and either a microprocessor or a simple logic circuit, also used to detect alarm conditions, function to produce an identifying signal when, during a prescribed time interval, the current level changes from the normal daytime level to the normal nighttime level. An oscillator responds to an identifying signal by producing a 5–20 Hz alternating signal. This alternating signal is applied through an optical isolator or an FET to a current limiter which is in series connection with the communications line.

The current limiter has a current control transistor and a low-value resistor in series connection with the communications line. A second transistor has its base-emitter junction in parallel with the resistor, to cut in when the current in the resistor reaches the value to which it is to be limited. The second transistor in conducting causes the current control transistor to decrease in conductivity, limiting the current. The oscillator alternately renders the current control transistor of decreased conductivity, either directly or via the second transistor. The current in the communications line is thereby alternately interrupted, which serves to ring a buzzer at the remote premises.

DESCRIPTION OF THE PREFERRED EMBODIMENT

A central alarm station contains apparatus for monitoring the supervisory current in a permanently connected telephone line a, sometimes referred to as a direct current line or a private line metallic circuit. From the central station, a 130 volt dc grounded positive power source b, conventional for security protection equipment, supplies power both to the telephone line a and to the central alarm station monitoring apparatus. The central station will supply a plurality of telephone lines a with a single power source b.

Figure 1:
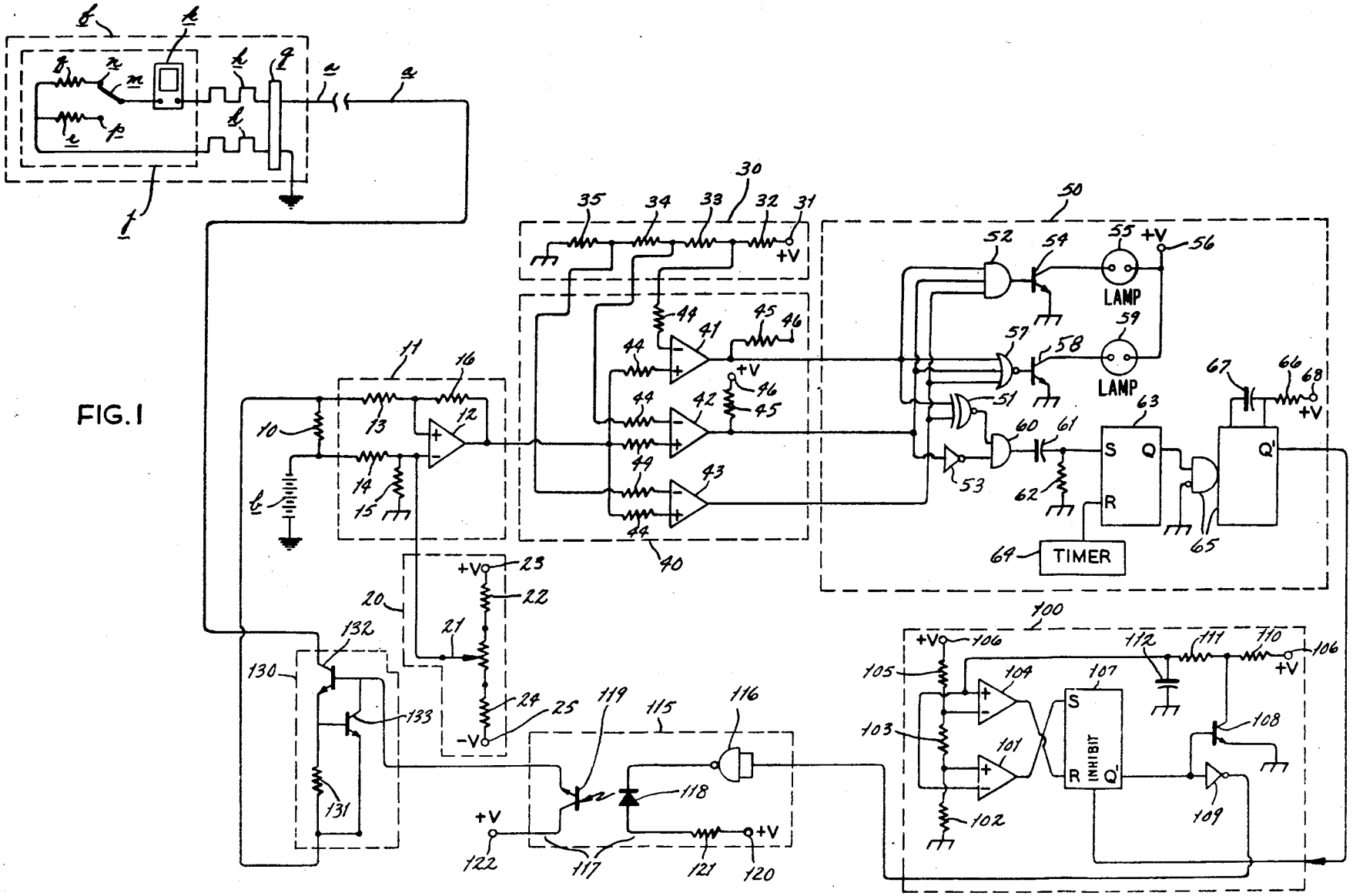
FIG. 1 is a fully detailed drawing of an embodiment of the present invention, utilizing a simple logic and signalling circuit to effect ringback to a single remote protected premises by a current limiter circuit modulated by an oscillator via an optical isolator.

The telephone line a, typically as long as 15 to 25 miles, is connected to the remote protected premises, generally designated f, in FIG. 1, where conventional protective devices such as a screen g or foil h, serve to open a protective circuit to decrease the current or cross a protective circuit to increase the current.

At the remote premises f a conventional subscriber's box, generally designated j, is utilized, including a buzzer k for signalling responsive to an oscillating signal in the telephone line a. The subscriber box j also contains a two-position switch, generally designated m, having a day contact n and a night contact p and being series connected to permit selection between a day resistor q and a night resistor r. The values of resistors q and r are chosen to set the current in the telephone line a at 30 mA when through the day resistor q and 20 mA when through the night resistor r, when the protective devices g and h are in normal conditions.

Elements common to both embodiments:

The central station apparatus of the present invention is installed at the central alarm station in electrical connection between the telephone line a and the power source b. As shown in FIG. 1, a sampling resistor 10 is connected in series with the telephone line a, with one terminal to the negative side of the power source b. An input circuit, generally designated 11, is coupled to the opposing ends of the sampling resistor 10 for sensing the current level in the sampling resistor 10. The input circuit 11 features an input operational amplifier 12 which has its noninverting input connected through a first input resistor 13 to that terminal of the sampling resistor 10 nearest to the telephone line a. The inverting input of the input operational amplifier 12 is connected through a second input resistor 14 to that terminal of the sampling resistor 10 connected to the power source b. In addition, a ground resistor 15 links the inverting input of the input operational amplifier 12 to a chassis ground, corresponding to the negative side of the power source b. A feedback resistor 16 is connected from the output to the noninverting input of the input operational amplifier 11. The first input resistor 13, the second input resistor 14, the ground resistor 15, and the feedback resistor 16 are all of substantially equivalent resistance.

Furthermore, a variable offset voltage source 20 has its output connected to the inverting input of the input operational amplifier 12. The wiper terminal of a potentiometer 21 forms this output. One remaining terminal of the potentiometer 21 is connected through a positive source resistor 22 to a positive dc voltage 23, relative to the chassis ground. The last terminal of the potentiometer 21 is connected through a negative source resistor 24 to a negative dc voltage 25, relative to the chassis ground. The terminal-to-terminal resistance of the potentiometer 21 is much smaller than the resistance of either the positive source resistor 22 or the negative source resistor 24. The positive dc voltage 23 and the negative dc voltage 25 may be supplied by a bipolar power supply, preferably in the range of 15 volts.

A voltage divider circuit, generally designated 30, has a dc voltage source 31 connected to a first voltage divider resistor 32, a second voltage divider resistor 33, a third voltage divider resistor 34, and a fourth voltage divider resistor 35, all in series with each other and to the chassis ground. The dc voltage source 31 and the voltage divider resistors 32, 33, 34, 35, are for purposes of this embodiment, so chosen such that the common terminal of the first and second voltage divider resistors 32, 33 is maintained at 3.5 volts, and the common terminal of the second and third voltage divider resistors 33, 34 is maintained at 2.5 volts, while the common terminal of the third and fourth voltage divider resistors 34, 35 is maintained at 1.5 volts, all relative to the chassis ground.

Comparator circuitry, generally designated 40, is coupled to both the voltage divider circuit 30 and the input circuit 11. The comparator circuitry 40 has a first comparator operational amplifier 41 which has its inverting input connected through a comparator input resistor 44 to that point of the voltage divider circuit 30 which produces 3.5 volts, being the common terminal of the first and second voltage divider resistors 32, 33. The noninverting input of the first comparator operational amplifier 41 is connected through a comparator input resistor 44 to the output of the input operational amplifier 12 of the input circuit 11. A second comparator operational amplifier 42 has its inverting input connected through a comparator input resistor 44 to that point on the voltage divider circuit 30 at which the second and third voltage divider resistors 33, 34 are connected, that point supplying 2.5 volts. The noninverting input of the second comparator operational amplifier 42 is likewise coupled to the output of the input operational amplifier 12. A third comparator operational amplifier 43 has its inverting input connected through a comparator input resistor 44 to that point on the voltage divider circuit 30 at which the third and fourth voltage divider resistors 34, 35 are connected. It thus receives 1.5 volts. The noninverting input of the third comparator operational amplifier 43 is connected to the output of the input operational amplifier 12. From the output of the first comparator operational amplifier 41 and from the output of the second comparator operational amplifier 42 are connected pull-up resistors 45 to a logic voltage source 46.

Logic and Signalling Circuitry—First Embodiment:

The outputs of the comparator circuitry 40, namely the outputs of the comparator operational amplifiers 41, 42, 43, are connected to a logic and signaling circuit, generally designated 50, which has the function of identifying current changes. The outputs of three comparator operational amplifiers 41, 42, 43 are connected to the inputs of a three-input AND gate 52. The output of the three-input AND gate 52 drives the base of a first npn transistor 54 whose emitter is connected to chassis ground and whose collector is connected to one terminal of a SHORT signaling lamp 55. The other terminal of the SHORT signaling lamp 55 is connected to a lamp voltage source 56, of sufficient voltage to light the lamp 55.

Likewise, the outputs of the three comparator operational amplifiers 41, 42, 43 are connected to the inputs of a three-input NOR gate 57. The output of the three-input NOR gate 57 drives the base of a second npn transistor 58. The emitter of the second transistor 58 is connected to chassis ground and the collector is connected to a terminal of an OPEN signaling lamp 59. The remaining terminal of the OPEN signaling lamp 59 is connected to the lamp voltage source 56.

The outputs of the first comparator operational amplifier 41 and the third comparator operational amplifier 43 are connected to the two inputs of an EXCLUSIVE OR gate 51. A two-input AND gate 60 receives the output of the EXCLUSIVE OR gate 51 at one of its inputs, and its other input is coupled to the output of the second comparator operational amplifier 42 by an inverter 53. The output of the two-input AND gate 60 is connected to a first terminal of a capacitor 61; the second terminal of the capacitor 61 being connected through a resistor 62 to chassis ground. The common terminal of the resistor 62 and capacitor 61 are connected to the "set" input of a first set-reset flip-flop 63. A timer 64 is connected to the "reset" input of the set-reset flip-flop 63. The "Q" output of the set-reset flip-flop 63 is connected to the positive going trigger input of a monostable multivibrator 65, often termed a "one-shot." The monostable multivibrator 65, as so far described, may be the 74L123 integrated circuit, manufactured by National Semiconductors Corp. and other integrated circuit manufacturers. As the purpose of the monostable multivibrator 65 is to produce an output pulse of predetermined length, a timing resistor 66 and a timing capacitor 67, along with a logic voltage source 68, must be provided to be connected as required by the integrated circuit chosen. The "Q" output of the monostable multivibrator 65 forms an output of the logic and signaling circuit 50.

Oscillator:

The output of the logic and signaling circuit 50 formed by the monostable multivibrator 65 output drives the input of an oscillator, generally designated 100, which includes a first oscillator operational amplifier 101 having a first oscillator resistor 102 connected from its noninverting input to chassis ground. A second oscillator resistor 103 is connected from the noninverting input of the first oscillator operational amplifier 101 to the inverting input of a second oscillator operational amplifier 104. That inverting input is connected through a third oscillator resistor 105 to a logic voltage source 106. The logic voltage source 106 is, in this embodiment, 5 V relative to chassis ground, and the resistors 102, 103, 104 are so chosen that the common terminals of the first and second resistors 102, 103 are maintained at approximately 1.6 V and the common terminals of the second and third resistors 103, 104 at approximately 3.3 V. The output of the first oscillator operational amplifier 101 is connected to the "set" input and the output of the second oscillator operational amplifier 104 is connected to the "reset" input of an oscillator set-reset flip-flop 107. The "inhibit" input of this set-reset flip-flop 107 receives the output of the monostable multivibrator 65. The "Q'" output of the oscillator set-reset flip-flop 107 drives the base of an npn oscillator transistor 108, which has its emitter connected to chassis ground. The "Q'" output of the set-reset flip-flop 107 is also connected through an inverter 109 to form the output of the oscillator 100. The portion of the circuit so far described may consist of a uA555 SINGLE TIMING CIRCUIT, manufactured by Fairchild Camera and Instrument Corp., except the logic voltage source 106 must be an external connection.

Several other external connections are required to complete the oscillator 100. From the collector of the oscillator transistor 108 a first-duty cycle resistor 110 is connected to the logic voltage source 106 and a second-duty cycle resistor 111 is connected to the inverting input of the first oscillator operational amplifier 101 and to the non-inverting input of the second oscillator operational amplifier 102. A duty cycle capacitor 112 connects those named oscillator operational amplifier inputs to chassis ground.

Isolation Circuit:

The output of the oscillator 100, that is, the output of the inverter 109, is connected to an input of an isolation circuit, generally designated 115. The isolation circuit 115 consists of a light-emitting diode (LED) driver 116 and an optical isolator 117. The LED driver 116 is in the form of a two-input NAND gate having its two inputs tied together and to the output of the oscillator 100. The optical isolator 117 is a four-terminal device having two terminals formed by the terminals of a light-emitting diode (LED) 118 and the remaining two terminals formed by the emitter-collector terminals of a phototransistor 119. The cathode of the LED 118 is connected to the output of the LED driver 116, and the anode of the LED 118 is connected to a positive dc voltage 120, such as +5 V relative to chassis ground, by a resistor 121. In the optical isolator 117, the LED 118 and phototransistor 119 are physically located adjacent to one another so that light emitted from the LED 118 will activate the phototransistor 119 in optical association. The collector of the phototransistor 119 is connected to an unregulated 15 V power supply 122.

Current Limiter:

The phototransistor outputs of the isolation circuit 115 is coupled to an electronic current limiter, generally designated 130, which is in series connection with the telephone line a between the telephone line a and the sampling resistor 10. The electronic current limiter 130 has a low value resistor 131, of 10 ohm resistance, in series with the communications line a and connected to the sampling resistor 10 on the side opposite the power source b. An npn current control power transistor 132 is connected in series in the communications line, with its emitter to the 10 ohm resistor 131, its collector to the telephone line a, and its base connected to the emitter of the phototransistor 119. A second npn transistor 133 has its base coupled to the emitter and its collector coupled to the base of the current control transistor 132; its emitter is connected to the 10 ohm resistor on its side opposite the power transistor 132.

Operation of First Embodiment:

In operation of the above described apparatus the two-position switch m is normally positioned to the day contact n to provide a 30 mA dc current in the telephone line a. In the evening of every working day, the last person to leave the remote premises switches the two-position switch m to night contact p, causing the current to fall to 20 mA dc.

Changes in the current in the telephone line a may be caused by the protective devices, including the screen g and foil h, which are shorted or opened upon security interruptions.

The sampling resistor 10, which for purposes of this embodiment, is a 100 ohm resistor, produces a voltage proportional to the current in the telephone line a. This voltage is presented across the inputs of the input operational amplifier 12, being of the type which has a high common mode rejection ratio. In addition, the variable offset voltage source circuit 20 produces a voltage which is supplied to the inverting input of the input operational amplifier 12. This voltage may be varied by changing the position of the wiper of the potentiometer 21. Because the first input resistor 13, second input resistor 14, feedback resistor 16, and ground resistor 15 are matched, the output of the input operational amplifier 12 is the sum of the voltage drop across the sampling resistor 10 and the voltage supplied by the variable offset voltage source circuit 20 and the high common mode rejection ratio of the input operational amplifier 12 is preserved. The function of the offset voltage source circuit includes permitting standardization of the voltage which appears across the sampling resistor 10 for varying lengths of telephone line, and of the central station apparatus for use with various desired normal supervisory current levels.

As described above, the voltage divider circuit 30 supplies the various required voltages to the inverting inputs of the comparator operational amplifiers 41, 42, 43. As connected, the first comparator operational amplifier 41 produces an output voltage of approximately 0 volts, hereafter called "digital low" or "low," when the output of the input operational amplifier 12 is less than 3.5 volts and an output voltage equal to the logic voltage source 46 voltage, hereafter called "digital high" or "high," when the output of the input operational amplifier 12 exceeds 3.5 volts. The pull-up resistor 45 assures that the output will go to the "digital high" voltage. Similarly, the second comparator operational amplifier 42 output will go high when the output voltage of the input operational amplifier 12 exceeds 2.5 volts and will be low when the output voltage does not exceed 2.5 volts. The third comparator operational amplifier 43 output goes high when the output of the input operational amplifier 12 exceeds 1.5 volts and low when it does not exceed 1.5 volts.

Together, the sampling resistor 10, input circuit 11, variable offset voltage source 20, voltage divider circuit 30, and comparator circuitry 40 are said to sense changes in the current in the telephone line a.

The EXCLUSIVE OR gate produces a high output when either, but not both, of its inputs are high. In this manner, the outputs of the EXCLUSIVE OR gate 51 and the second comparator operational amplifier 42 are sufficient to indicate the four conditions desired to be observed:

1. "SHORT circuit"—When the output of the input operational amplifier 12 exceeds 3.5 volts, the outputs of all the comparator operational amplifiers 41, 42, 43 are high and the output of the EXCLUSIVE OR gate 51 is low.

2. "OPEN circuit"—When the output of the input operational amplifier is less than 1.5 volts, the outputs of all the comparator operational amplifiers 41, 42, 43 and the EXCLUSIVE OR gate 51 are low.

3. Normal daytime current—When the output of the input operational amplifier 12 is greater than 2.5 volts and less than 3.5 volts, the outputs of the second and third comparator operational amplifiers 42, 43 and the EXCLUSIVE OR gate 51 are high, and the output of the first comparator operational amplifier 41 is low.

4. Normal nighttime current—When the output of the input operational amplifier 12 exceeds 1.5 volts, but is less than 2.5 volts, the outputs of the third comparator operational amplifier 43 and the EXCLUSIVE OR gate are high and the outputs of the second and third comparator operational amplifier 42, 43 are low.

The output of the three-input AND gate 52 is only high when the digital signals which indicate a SHORT are present, that is, when the outputs of all the comparator operational amplifiers 41, 42, 43 are high. When the output of the AND gate 52 goes high the first transistor 54 becomes conductive and the SHORT signaling lamp 55 is lighted.

The three-input NOR gate 57 produces a high output only when the digital signals indicating an OPEN are present, that is, when the outputs of all the comparator operational amplifiers 41, 42, 43 are low. A high output from this NOR gate 57 causes the second transistor 58 to conduct, lighting the OPEN signaling lamp 59.

The output of the two-input AND gate 60 only becomes high when the digital signals indicating normal nighttime current exist. If its output should go high due to switching at the remote premises of the two-position switch m to the night contact p, for example, a voltage spike, or short momentary increase, is presented at the "set" input of the set-reset flip-flop 63, due to the action of the resistor-capacitor combination 62, 61.

The timer 64, which may be an electro-mechanical or an electrical device, produces an output voltage corresponding to a digital "high" in all times of day other than the late afternoon and early evening, for example, from 3:00 PM to 8:00 PM. During those hours, a low digital signal is provided at the output, verifying that during the selected time period a ringback signal is appropriate. Thus, during the hours from 3:00 to 8:00 PM the flip-flop 63 is enabled by the digital signal 20 that a voltage spike on the "set" input of the set-reset flip-flop 63 latches the flip-flop "Q" output high. But if the spike should occur during another time of the day, the "reset" input will be receiving a high signal from the timer 64, overriding the "set" input.

Upon reception of a latched high output from the "Q" output of the set-reset flip-flop 63, the monostable multivibrator 65 produces a "low" pulse at its "Q" output. This output of the monostable multivibrator 65 is otherwise normally high. The time duration of the pulse is determined by the values of the timing resistor 66 and timing capacitor 67 and for purposes of this embodiment, the timed interval to which the interruptions are restricted is about three seconds.

When the oscillator 100 is not oscillating and is in its stable position, its output is high; the output of the LED driver 116 is then low, causing the LED 118 to conduct. The input to the inverter 109 is low, because the high received at the inhibit input of the set-reset flip-flop 107 forces its Q' output low. While the oscillator 100 is in this nonoscillating condition, the oscillator transistor 108 is nonconducting, since its base is low. Thus, the duty cycle capacitor 112 is charged up to the 5 V level of the logic voltage source 106. The first oscillator operational amplifier 101, which receives this voltage at its inverting input, has a low output, while the second oscillator operational amplifier, which receives the 5 V at its non-inverting input, has a high output. These outputs are respectively received at S and R inputs of the set-reset flip-flop 107.

When the output of the monostable multivibrator 65 goes low, the flip-flop 107 is no longer inhibited and its Q' output goes high, causing the output of the oscillator 100 to go low. The oscillator transistor 108 conducts and the duty cycle capacitor 112 discharges. As it discharges to below 3.3 V, the output of the second oscillator operational amplifier 104 and the R input of the flip-flop 107 becomes low. As it further discharges to below 1.6 V, the output of the first oscillator operational amplifier 101 and the S input of the flip-flop 107 go high and the Q' output of the flip-flop goes low. The output of the oscillator 100 is thus high.

As the "Q'" output is now low, the oscillator transistor 108 is nonconducting, allowing the capacitor 112 to charge. At 1.6 V, the output of the first oscillator operational amplifier 101 becomes low and at 3.3 V, the output of the second oscillator operational amplifier 104 becomes high, causing the "Q'" output of the flip-flop to go high, completing a cycle. Such cycles continue, forming a square wave output of 0–5 V, preferably in the range of 5–20 Hz.

The LED 118 of the optical isolater 117 conducts and becomes lighted when the driver 116 receives a high voltage (the digital supply voltage) from the oscillator 100. The LED 118 does not conduct or light when the driver 116 receives a low from the oscillator 100. The phototransistor 119 responds to the light from the LED 118 by becoming conductive upon receiving such light. An oscillating signal may be thereby produced at the output of the isolation circuit 115. When the oscillator 100 is not oscillating, the output of the phototransistor 119 is high.

The electronic current limiter 130 serves two functions: to limit the current in the telephone line a to less than approximately 50 mA; and to limit the current to lower values reponsive to the optical isolator 115. In limiting the current to less than 50 mA, the 10 ohm resistor 131, which for purposes of this embodiment is capable of dissipating at least one watt, produces a voltage proportional to the current through the telephone line a. As the current through the telephone line a nears 50 mA, the voltage across the 10 ohm resistor 131 approaches 0.5 V; the second transistor 133, which, for the purpose of this embodiment, is a silicon transistor, then becomes conducting. This diverts the current supplied by the normally on phototransistor 119 away from the base of the current control transistor 132, causing it to become less conducting or nonconducting. In such manner, a quiescent state is reached, even though in the absence of the current limiter 130 the current might reach much higher than 50 mA.

The current limiter 130 can serve to reduce the current to values lower than the 50 mA limit by varying the conductivity of the current control transistor 132. In this manner, an alternating interruption is achieved by the coupling of the oscillator 100 to the current control transistor 132 by the isolation circuit 115. The phototransistor 119, which is normally conducting, alternately becomes nonconducting, which causes the current control transistor to alternately become nonconducting, reducing the current in the communications line a to zero at each interruption. By causing the line current to fall to zero, residual voltage on the long line caused by its capacitance to ground is discharged. This operation of the current limiter 130 may be described as providing a variable resistance which alternately varies responsive to the isolation circuit 115 output, or more simply as a current limiter in which the value to which the current is limited may be reduced and restored. The rise and fall of the current in the telephone line a is sufficient to activate the electromagnetic buzzer k.

Summing up, when the two-position switch m at the protected premises f is switched to the night contact p from the day contact n, and the current falls from 30 mA to 20 mA, the monostable multivibrator 65 goes low for 3 seconds. During that time, the oscillator 100 produces a square wave output, to which the current limiter 130 responds by providing alternating interruptions of the current. This rings the buzzer k.

The advantages of this system are numerous. By providing alternating interruptions or reductions in the current in the telephone line a instead of switching in an alternating power source, the necessity for an extra power source is eliminated, and time intervals in which there is no monitoring are minimized. The insertion into the circuit of condition verifying devices is facilitated; and the current limiter 130, useful for limiting the current in the telephone line a, is put to an added novel use.

Figure 2:
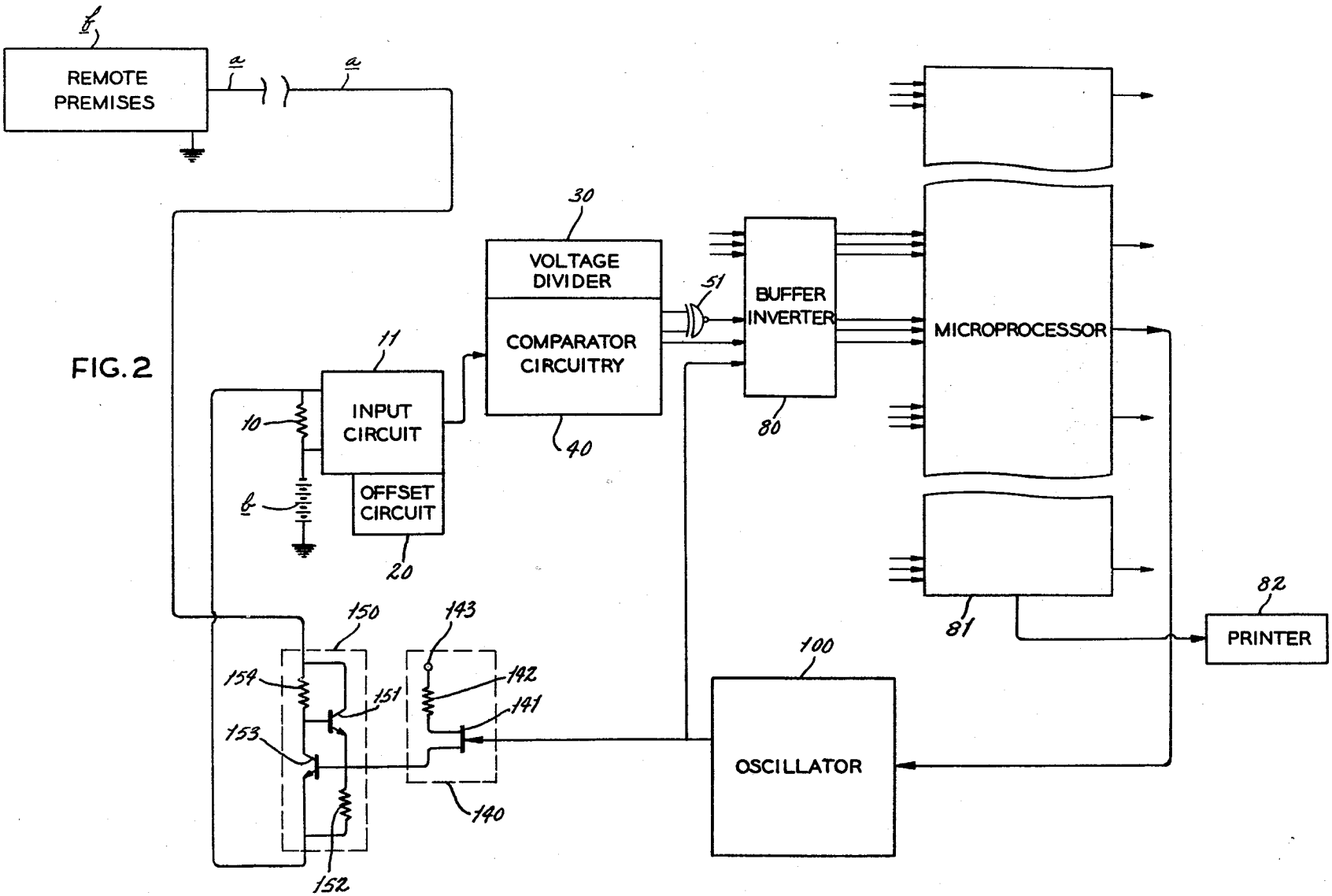
FIG. 2 is a circuit drawing partly in block form of a more complex embodiment, utilizing a microprocessor to effect ringback to a plurality of such remote premises by another current limiter circuit modulated by an oscillator via an FET.

Second Embodiment:

A second embodiment of the present invention, as shown in FIG. 2, utilizes state-of-the-art integrated circuitry in automatic ringback apparatus capable of simultaneously handling signals from as many as 144 separate premises in this construction.

This embodiment similarly embodies the following elements and circuits of the previously described embodiment: the telephone line a, the grounded positive power source b, the protected premises f, the sampling resistor 10, the input circuit 11, the variable offset voltage source circuit 20, the voltage divider circuit 30, the comparator circuitry 40, and the oscillator 100. In addition, the EXCLUSIVE OR gate 51 of the previous embodiment is likewise included, and supplies identical digital signals as in the previously described embodiment.

The output of the EXCLUSIVE OR gate 51 and the accompanying output from the second comparator operational amplifier 42, along with a line from the output of the oscillator 100, form three inputs of a buffer-inverter integrated circuit 80. The buffer-inverter 80 has six inverters, three receiving the three above described inputs indicating the status of remote premises N. The remaining three inverters are used to indicate the conditions at another remote premises specified as premises N−1, shown in FIG. 2. The six outputs of the buffer-inverter 80 are merely its inputs inverted.

The outputs of the buffer-inverter 80 are connected to inputs of a microprocessor integrated circuit 81, along with lines from 142 other premises, as shown in FIG. 2. The microprocessor 81 is connected to input-output circuitry; for example, a printer 82 which indicates the conditions of each remote premise. In addition, the microprocessor 81 has an output to the oscillator 100 which, as did the logic circuit 50 of the previous embodiment, indicates when a ringback signal should be given. The microprocessor 81 may include a verifying timer, so that a ringback signal is only produced during early evening hours, as described in the previous embodiment. Because of the capability of the microprocessor, it will be obvious to impose other desired verifying conditions.

The output of the oscillator 100 is coupled to a current limiter circuit 150 by an isolator circuit 140. The isolator circuit 140 is comprised of an n-channel power field effect transistor (FET) 141 having its gate connected to the output of the oscillator 100. The drain of the FET 141 is coupled through a pull-up resistor 142 to a dc voltage source 143, such as 10 V relative to chassis ground.

The source of the FET 141 is coupled to an electronic current limiter 150 different in its circuitry than the above-described current limiter 130, but similarly in series between the telephone line a and the sampling resistor 10. The current limiter 150 has a current control npn power transistor 151 having its collector to the telephone line a and its emiter to a low fixed-value resistor 152 (10 ohms) whose other terminal is connected to the sampling resistor 10 opposite the power source b; these are thus in series with the telephone line a. A second transistor 153, of the silicon npn type, has its base connected to the emitter of the current control transistor 151, its emitter to the fixed value resistor 152 at its side to the sampling resistor 10, and its collector to the base of the current control transistor 151. The current limiter 150 is completed by a biasing resistor 154 between the base and collector of the current control transistor 151.

Operation of Second Embodiment:

In operation of this embodiment, the microprocessor 81 may be programmed in the following manner for the desired operation 1. The microprocessor is in a loop, constantly checking for a change in the individual signals indicating current levels at remote premises. It checks the indications from PREMISE 1 through PREMISE 144 and then begins again.

2. If the microprocessor 81 detects a change to normal night current, it jumps out of the loop.

3. Then the microprocessor 81 branches to a subprogram which, subject to imposed verifying conditions, sends a ring signal to the oscillator for the selected time interval.

4. Then the microprocessor 81 tests to see if the ring signal has been turned off.

5. The microprocessor 81 returns to looping as in No. 1 above.

Again, in the second embodiment, the current limiter 150 serves two functions. First, the current is limited to approximately 50 mA; as the current in the telephone line a nears 50 mA, the voltage across the 10 ohm resistor 152 nears 0.5 V, causing the second transistor 153 (silicon) to conduct. This pulls current out of the base of the current control transistor 151, causing it to become less conducting or nonconducting. In such manner, a quiescent state is reached, even though in the absence of the current limiter 150 the current might reach much higher than 50 mA.

Second, the current limiter 150 may impose lower limits on the current, or cause the current to go to zero. The oscillator 100 is normally high when not oscillating and the FET 141 is off. When the oscillator 100 oscillates, the FET 141 alternately is turned on, driving current through the 10 ohm resistor 152 and into the base of the second transistor 153, causing it to conduct. As previously described, this causes the current control transistor 151 to become less conducting; since current continues the flow from the FET 141 after the current in the telephone line a drops, no quiescent state is reached; instead, the current in the telephone line a may be reduced practically to zero. The alternating reduction and restoration of the current is sufficient to ring the buzzer k.

This embodiment of the present invention has the advantage of the extreme miniaturization permitted by a microprocessor and the resulting convenience available by the use of printers, CRT displays and other conventional output devices. There may in addition be a considerable cost savings, since one microprocessor may be handling the information from 144 premises and making all decisions as to ringing back for all 144 premises.

The scope of the invention is not to be deemed limited to the two above described embodiments. Many variations will suggest themselves from this disclosure. For example, the isolation circuit might, under certain circumstances, be deleted, or could be replaced by another transistor or optical isolator, such as one having a light-emitting diode in optical association with a photoresistor.

Instead of imposing an oscillating current in the form of a square wave signal upon the telephone line a, any form of fluctuating current might be utilized for producing any desired signal at the remote premises or at any point along the telephone line a. For the oscillator 100 there may be substituted any electro-mechanical or electrical device for producing some type of signal to be imposed upon the current in telephone line a. The logic and signaling circuit 50 or the microprocessor 81, as disclosed above, are only examples of circuits for identifying current changes. The timer, for permitting a ringback during the hours of 3:00 to 8:00 PM, illustrates a simple restriction on the ringback in response to an outside verifiable contemporaneous condition; namely, the time of day. For other purposes, more complex condition-vertifying circuitry may be introduced. Such modifications, as well as others, will be apparent to persons skilled in the art.

We claim:

1. In a monitoring system having a communications line from a central station to remote premises and a source of direct current therefor, the remote premises having selector switch means for producing a plurality of normal current levels in the communications line and signal means of a type which responds to oscillations in the current in the communications line, central station apparatus comprising means for sensing the level of the current in the communications line, means for identifying a change between normal current levels produced by change of the selector switch means, and means, responsive to said identification, to provide an alternating interruption of the level of the direct current in the communications line, including an oscillating voltage source, and a current limiter in the communications line responsive thereto, whereby when the current changes from one normal current level to another, said current limiter produces oscillations in the current in the communications line to which said signal means responds.

2. The central station apparatus as defined in claim 1, wherein said means to provide an alternating interruption is of the type which, in the interruption, reduces the direct current to zero.

3. The central station apparatus as defined in claim 1, wherein said means to provide an alternating interruption restricts the interruption to a timed interval.

4. The central station apparatus as defined in claim 1, together with means to enable imposition of the alternating interruption only during a selected time period.

5. In a monitoring system having a communications line from a central station to remote premises and a source of direct current therefor, the remote premises having selector switch means for producing a plurality of normal current levels in the communications line and signal means of a type which responds to oscillations in the current in the communications line, central station apparatus comprising means for sensing changes in the level of the current in the communications line, means for identifying those current changes from one to another of said plurality of normal current levels, thereby to identify changes of condition of the selector switch, means, responsive to said identification, to supply an oscillating voltage, and current control means, in the communications line and operatively coupled to said means to supply an oscillating voltage, to both impose a limit on the current in the communications line and to alternately reduce and restore the imposed limit in response to the oscillating voltage, whereby to provide oscillations in the current in the communications line to which such signal means responds.

6. The central station apparatus as defined in claim 5, wherein said current control means includes a current control transistor in series connection with the communications line whose base is operably coupled to said means to supply an oscillating voltage.

7. The central station apparatus as defined in claim 5, wherein said current control means comprises a current control transistor in series connection with the communications line, a resistor of fixed value in series connection with the communications line, a second transistor, and means operatively connected between said current control transistor, said resistor and said second transistor, both to render said current control transistor less conductive upon increasing current in said resistor and to alternately reduce and restore the level of the direct current in response to the oscillating voltage.

8. The central station apparatus as defined in claim 5, wherein said means to supply an oscillating voltage to said current limiting means includes an optical isolator.

9. The central station apparatus as defined in claim 5, wherein said means to supply an oscillating voltage to said current limiting means includes a field effect transistor.

* * * * *

UNITED STATES PATENT AND TRADEMARK OFFICE

CERTIFICATE OF CORRECTION

PATENT NO. : 4,282,517

DATED : August 4, 1981

INVENTOR(S) : Stanley Wilson, Jr.
Robert M. Borger

It is certified that error appears in the above—identified patent and that said Letters Patent is hereby corrected as shown below:

Column 4, line 66, delete "Q" and substitute ---Q'---;

Column 11, line 21, delete "the" first occurrence and substitute ---to--;

Column 11, line 57, delete "vertifying" and substitute ---verifying---.

Signed and Sealed this

*Twentieth* Day of *October 1981*

[SEAL]

*Attest:*

GERALD J. MOSSINGHOFF

*Attesting Officer*

*Commissioner of Patents and Trademarks*